US006081959A

United States Patent [19]

Umbrell

[11] Patent Number: 6,081,959

[45] **Date of Patent: *Jul. 4, 2000**

[54] BUFFER CENTERING SYSTEM

[76] Inventor: Richard Umbrell, 2139 E. Del Amo Blvd., Rancho Dominguez, Calif. 90220

[ * ] Notice: This patent issued on a continued prosecution application filed under 37 CFR 1.53(d), and is subject to the twenty year patent term provisions of 35 U.S.C. 154(a)(2).

[21] Appl. No.: 08/674,549

[22] Filed: Jul. 1, 1996

[51] Int. Cl.[7] ..... B24B 29/00

[52] U.S. Cl. ..... 15/230.19; 15/230; 15/230.12

[58] Field of Search ..... 15/230, 230.12, 15/230.14, 230.15, 230.16, 230.17, 230.18, 230.19; 451/321, 359, 360, 510

[56] References Cited

U.S. PATENT DOCUMENTS

| | | | |
|---|---|---|---|
| Re. 35,021 | 8/1995 | Englund et al. . | |
| 577,860 | 3/1897 | Keighley | 451/510 |
| 816,461 | 3/1906 | Gorton . | |
| 1,525,225 | 2/1925 | Chase . | |
| 1,877,527 | 9/1932 | Moran . | |
| 1,953,983 | 4/1934 | Benner . | |
| 2,242,877 | 5/1941 | Albertson . | |
| 2,263,883 | 11/1941 | Livermont | 15/230.19 |
| 2,269,721 | 1/1942 | Johnson . | |
| 2,319,873 | 10/1943 | Linz . | |
| 2,347,244 | 4/1944 | Colt et al. . | |
| 2,501,524 | 3/1950 | Jones | 451/510 |
| 2,653,428 | 9/1953 | Fuller . | |
| 2,804,733 | 9/1957 | Hurst . | |
| 2,835,911 | 5/1958 | Mahmarian . | |

(List continued on next page.)

FOREIGN PATENT DOCUMENTS

| | | | |
|---|---|---|---|
| 1106611 | 11/1981 | Canada . | |
| 0004454 | 10/1979 | European Pat. Off. . | |
| 0095015 | 11/1983 | European Pat. Off. . | |
| 0196832 | 10/1986 | European Pat. Off. . | |
| 0379361 | 7/1990 | European Pat. Off. . | |
| 1254735 | 1/1961 | France . | |
| 1502347 | 7/1969 | Germany . | |
| 3043044 | 6/1982 | Germany . | |
| 3201825 | 7/1983 | Germany . | |
| 50-15764 | 2/1975 | Japan . | |
| 58-4361 | 1/1983 | Japan . | |
| 3130366 | 12/1991 | Japan . | |
| 42565 | 1/1992 | Japan . | |
| 419766 | 2/1992 | Japan . | |
| 460662 | 5/1992 | Japan . | |
| 3032962 | 1/1997 | Japan . | |
| 638967 | 10/1983 | Switzerland . | |
| 313850 | 3/1930 | United Kingdom . | |
| 0671501 | 5/1952 | United Kingdom | 451/510 |
| 990142 | 4/1965 | United Kingdom . | |
| 2043501 | 10/1990 | United Kingdom . | |

OTHER PUBLICATIONS

Buff and Shine Performance Products Catalog.

*Primary Examiner*—Randall E. Chin
*Attorney, Agent, or Firm*—O'Melveny & Myers LLP

[57] ABSTRACT

The present invention involves a centering system for a polishing pad that is releasably attached to a backing mount. The pad has a generally flat polishing face and may employ a fabric shag pile or foam for buffing, polishing, or otherwise finishing a surface, such as painted sheet metal. The opposite face of the pad is a mounting surface and has an axially aligned centering post projecting therefrom toward the backing mount. The backing mount is a stiff structure that has a socket defined at its axial center. The size and cross section of the socket are configured to conform to the size and cross section of the centering post so that the centering post on the mounting surface of the pad fits snugly into the coaxially aligned socket on the facing side of the backing mount. Mutually engageable layers of flexible, hook and loop fastening material are respectively attached to the mounting surface of the pad and the surface of the backing mount that faces the pad. The flexible hook and loop fastening system thereby releasably attaches the pad to the backing mount, while the centering system maintains the pad and backing mount in mutually coaxial alignment.

28 Claims, 4 Drawing Sheets

U.S. PATENT DOCUMENTS

| | | | |
|---|---|---|---|
| 2,838,890 | 6/1958 | McIntyre . | |
| 3,009,235 | 11/1961 | Mestral . | |
| 3,100,905 | 8/1963 | Salick | 15/230.19 |
| 3,171,820 | 3/1965 | Volz . | |
| 3,177,820 | 4/1965 | Pazar et al. . | |
| 3,196,586 | 7/1965 | Brown et al. . | |
| 3,302,232 | 2/1967 | Wasiloff et al. . | |
| 3,324,608 | 6/1967 | Hoenig . | |
| 3,346,904 | 10/1967 | Armstrong . | |
| 3,418,675 | 12/1968 | Meguiar et al. . | |
| 3,468,079 | 9/1969 | Kaufman . | |
| 3,495,362 | 2/1970 | Hillenbrand . | |
| 3,498,010 | 3/1970 | Hagihara . | |
| 3,499,250 | 3/1970 | Jensen et al. . | |
| 3,512,204 | 5/1970 | Jagiel . | |
| 3,529,385 | 9/1970 | Stein . | |
| 3,537,121 | 11/1970 | McAvoy . | |
| 3,597,887 | 8/1971 | Hall, Jr. . | |
| 3,655,444 | 4/1972 | Young . | |
| 3,757,378 | 9/1973 | Wakefield | 15/230.19 |
| 3,823,516 | 7/1974 | Christian . | |
| 3,844,072 | 10/1974 | Haigh | 451/510 |
| 3,866,361 | 2/1975 | Mauck | 451/510 |
| 3,869,263 | 3/1975 | Greenspan . | |
| 3,981,106 | 9/1976 | Gallo | 15/230 |
| 4,055,029 | 10/1977 | Kalbow . | |
| 4,111,666 | 9/1978 | Kalbow . | |
| 4,114,225 | 9/1978 | Malish et al. . | |
| 4,182,616 | 1/1980 | Gadbois et al. . | |
| 4,263,755 | 4/1981 | Globus . | |
| 4,291,508 | 9/1981 | Prunier . | |
| 4,343,112 | 8/1982 | Jarrett . | |
| 4,502,174 | 3/1985 | Rones . | |
| 4,576,612 | 3/1986 | Shukla et al. . | |
| 4,609,481 | 9/1986 | Tsubouchi et al. . | |
| 4,609,581 | 9/1986 | Ott . | |
| 4,692,958 | 9/1987 | McMakin . | |
| 4,715,150 | 12/1987 | Takeuchi et al. . | |
| 4,747,176 | 5/1988 | Parks | 15/230.16 |
| 4,788,798 | 12/1988 | DeFranco et al. . | |
| 4,841,680 | 6/1989 | Hoffstein et al. . | |
| 4,907,313 | 3/1990 | Roeker et al. . | |
| 4,930,179 | 6/1990 | Wright et al. . | |
| 4,969,226 | 11/1990 | Seville . | |
| 4,989,304 | 2/1991 | Sonefors . | |
| 5,001,804 | 3/1991 | Roeker et al. . | |
| 5,003,659 | 4/1991 | Paepke . | |
| 5,007,128 | 4/1991 | Englund et al. . | |
| 5,114,255 | 5/1992 | Villarreal . | |
| 5,123,139 | 6/1992 | Leppert | 15/230 |
| 5,138,735 | 8/1992 | Kusz | 15/230 |
| 5,150,546 | 9/1992 | Tucker | 451/359 |
| 5,172,448 | 12/1992 | Kitahata . | |
| 5,174,795 | 12/1992 | Wiand . | |
| 5,214,820 | 6/1993 | Shumway et al. . | |
| 5,249,329 | 10/1993 | Arnold . | |
| 5,257,478 | 11/1993 | Hyde et al. . | |
| 5,309,681 | 5/1994 | Cheney et al. . | |
| 5,311,634 | 5/1994 | Andros . | |
| 5,390,449 | 2/1995 | Hilton . | |
| 5,396,737 | 3/1995 | Englund et al. . | |
| 5,527,215 | 6/1996 | Rubino et al. . | |

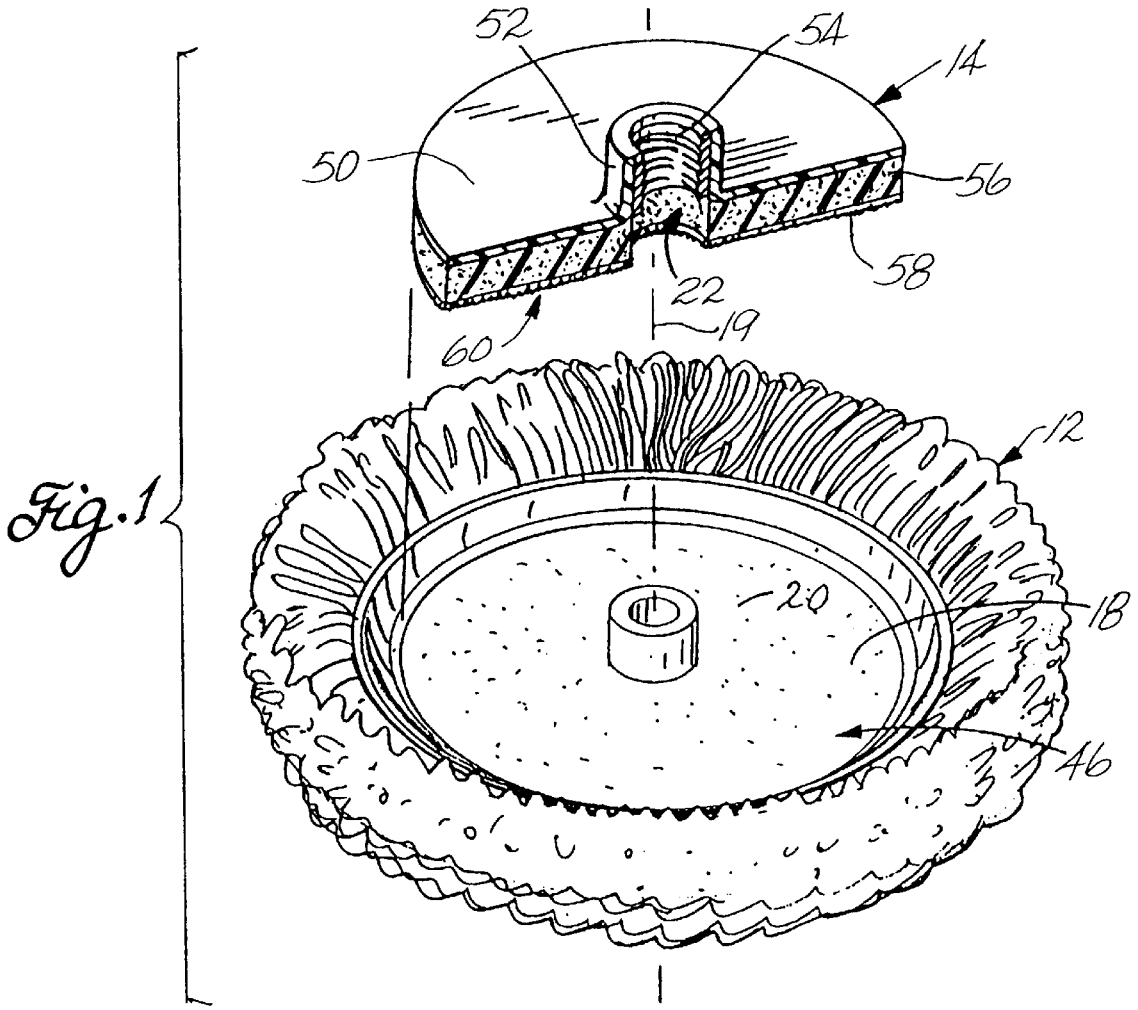
Fig. 1
Fig. 9
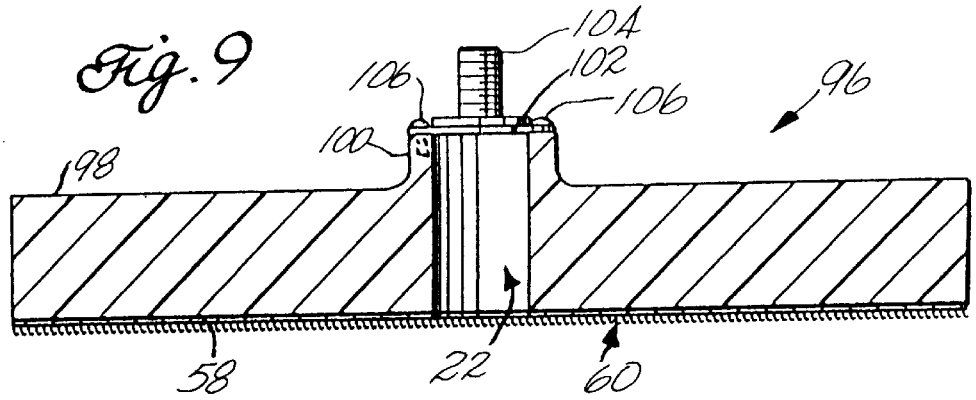

BUFFER CENTERING SYSTEM

BACKGROUND OF THE INVENTION

1. Field of the Invention

The present invention relates to a system for centering a polishing, paint buffing, or paint finishing pad relative to a stiff backing mount. Such pads are typically used to polish, buff, and otherwise finish painted surfaces, such as the painted sheet metal bodies of automotive vehicles.

2. Description of the Prior Art

In finishing hard, painted surfaces the conventional procedure is to buff the surfaces with a soft, cushioning buffing pad using paint finishing, polishing, or buffing compounds of increasing fineness in successive buffing steps. Buffing machines are typically hand held, electrically operated devices that include a generally disk-shaped backing mount for a soft buffing pad. The pad is removably mounted on the backing mount. The backing mount is driven in rotation about a driving axis by an electric motor in the machine, thus turning the pad in rotation as well. The pad is rotated about the driving axis causing the buffing, cutting compound, polish, or glaze to smooth out irregularities in the paint on a painted surface to be finished. Buffing pads of this type are very often used to create a sheer, glossy shine on the surfaces of automotive vehicle bodies that have been painted or repainted, or upon vehicle bodies where oxidation of the paint has occurred and the paint needs to be reconditioned.

A number of different systems have been utilized for securing the soft buffing pad to a backing mount. For many years the standard arrangement was to provide an axially centered opening in the finishing pad and pass the threaded shank of a bolt up through the center of the polishing pad back toward the backing mount. The shank of the bolt was then engaged with a corresponding tapped barrel or sleeve in the backing mount, while the shoulder beneath the head of the bolt clamped the buffing pad against the backing mount.

The head of the bolt was much thinner than the buffing or polishing material which is typically wool fabric or polyurethane foam. A recess in the polishing material was formed at the center of the pad so that the head of the bolt was thereby buried within the polishing material of the pad so as not to contact the painted surface being buffed or polished as the pad rotated. However, individuals operating the buffer or polishing machine can press the buffing pad against the surface being polished with a force sufficient to bring the head of the mounting bolt into contact with the painted surface. Of course, when this occurs there is considerable damage to the paint.

Also, buffing pads with a center mounting bolt could not easily be changed, since each change of a buffing pad required the user to loosen the mounting bolt using a screwdriver or wrench, remove and replace the pad, and retighten the bolt using a screwdriver or wrench. Also, the use of a mounting bolt entailed an additional disadvantage in that if the bolt was not thoroughly tightened, it could come loose during the operation of the buffer or polisher, thus causing damage to the paint finish. As a consequence, other means for fastening paint finishing pads to the stiffer backing mounts were devised.

One particularly popular system for releasably attaching a paint finishing pad to a backing mount is to provide the mounting surface of the pad and the corresponding, facing surface of the backing mount with contact layers bearing mutually engageable hook and loop fabric fasteners. Such hook and loop fasteners form releasable closures having mutually engageable contact surfaces, one of which bears a multiplicity of projecting flexible hooks, typically formed of nylon or other plasticized fabric. The other contact surface bears a flexible, looped pile.

One contact layer, typically the layer bearing the flexible hooks, is attached to the surface of the backing mount that faces the paint finishing pad. The other contact layer, typically the layer bearing the looped pile, is permanently secured to the mounting face of the pad that lies opposite the polishing face. When the contact layers are even lightly pressed together the hooks become releasable engaged in the pile. Such releasable fasteners have been sold for many years under the registered trademark Velcro® and are described, for example, in U.S. Pat. No. 3,009,235. The attachment system for a polishing head having a detachable pad is described, for example, in U.S. Pat. No. 3,346,904.

By employing a releasable, flexible, fabric hook and loop fastening arrangement, it is unnecessary for any hard object that might damage the surface being finished to be located at the polishing face of the pad. However, one problem which has arisen in elimination of the mounting bolt for fastening the finishing pad to the backing mount is that there is no means for centering the pad relative to the backing mount. As a result, if the pad is placed off center on the backing mount, significant lateral forces are produced in operating the buffer, polisher, or paint finishing machine. These forces must be overcome by the operator, thereby contributing greatly to operator discomfort and fatigue.

One solution which has been attempted to remedy this problem was to configure the mounting surface of the buffing pad such that the outer periphery of the pad surrounding the mounting surface was turned up toward the backing mount to provide an axially extending lip. The backing mount was then enlarged so that the outer, peripheral edge of the backing mount extended all the way to the lip of the flexible backing pad to fit snugly therewithin. Thus, the pad was centered relative to the mount. This system is described in U.S. Pat. No. 5,001,804.

However, configuring the backing mount to fit snugly into the back of the pad also entailed several significant problems. A major disadvantage of the system of U.S. Pat. No. 5,001,804 is that a backing mount can be used only with pads of a specific size. If a larger or smaller pad is to be employed, a corresponding larger or smaller backing mount must also be employed in order for the system to be effective, or even operable. Also, by expanding the size of the backing mount so as to fit within the confines of the flange on the pad backing, both the weight and the expense of the backing mount were greatly increased.

SUMMARY OF THE INVENTION

The present invention involves a system for centering a rotatable surface-finishing pad relative to a stiff backing mount that avoids the problems of the prior art. Specifically, the centering system of the present invention does not involve any hard structure located near the polishing face of the pad. Also, the centering system of the invention does not require the stiff backing mount to be laterally expanded, nor does it require any particular coordination between the size of the backing and the size of the finishing pad. To the contrary, the present invention provides a light-weight, economically produced means for centering a paint-finishing pad relative to a backing mount. Furthermore, the system of the invention is highly versatile and allows finishing pads of different sizes to be used with the same backing mount.

In one broad aspect the present invention may be considered to be an improvement in an apparatus for releasably attaching a rotatable, surface-finishing pad having a surface-finishing face and an opposing mounting face to a stiff backing mount. According to the improvement of the invention the surface-finishing pad is provided with an axially aligned centering post of uniform cross-sectional configuration throughout projecting from the mounting face of the pad, and with an axially aligned socket defined in the stiff backing mount and formed with a uniform inner cross section to snugly receive the centering post of the surface finishing pad therewithin.

Preferably, the mounting face of the surface-finishing pad and the stiff backing mount include a pair of mutually engageable, contact-sensitive members. One of the contact-sensitive members in the pair is formed with a multiplicity of minute flexible hooks. The other of the contact-sensitive members is formed with a looped, fabric pile thereon. The flexible hooks are releasably engageable with the pile when the contact-sensitive members are brought into contact with each other. However, unlike prior systems that employ flexible hook and loop fasteners, the surface-finishing pad and backing mount are guided into mutually coaxial alignment as the pad is placed upon the mount by means of engagement of the centering post on the mounting surface of the pad in the socket of the backing mount.

While the centering post and socket may be formed in any geometric configuration of uniform cross section, they are both preferably cylindrical. In its fabrication the surface-finishing pad is preferably provided with a flanged barrel of generally T-shaped, cross-sectional configuration. The flanged barrel has a cylindrical annular portion that forms the centering post for the pad and a radially projecting annular flange that is permanently embedded in the surface-finishing pad between the surface-finishing face and the mounting face of the pad.

Preferably the surface-finishing pad is formed with at least two annular plastic layers residing in mutual contact with each other and located proximate the mounting face. The annular flange resides between the plastic layers which are thereafter fused together throughout an interface of mutual contact. The flange of the flanged barrel is thereby permanently anchored to the structure of the pad. Preferably also, the annular flange has a plurality of apertures defined therethrough so that the layers of plastic are fused together through the apertures, thereby forming an interlocking connection that enhances the strength with which the flanged barrel is anchored to the pad.

In another broad aspect the invention may be considered to be an improvement in a power-driven apparatus for finishing a surface by rotating a finishing pad thereagainst, wherein the finishing pad is releasably attached to a stiff mounting. The improvement is comprised of an axially aligned centering post of uniform outer cross section throughout projecting from the pad and an axial socket defined in the stiff mounting and having a uniform inner cross section that snugly receives the centering post. The fit of the centering post within the socket thereby maintains the finishing pad and the stiff mounting in mutually coaxial alignment.

In still another broad aspect the invention may be considered to be a combination formed of a polishing pad for rotation about a driving axis, a centering projection extending coaxially from the pad, and a socket in the pad backing mount. The pad has one polishing face and an opposite mounting face. The centering projection is firmly secured to the pad and has a uniform outer configuration. The centering projection extends axially from the mounting face of the pad. The socket on the pad backing mount is of a uniform inner cross section throughout and is formed to snugly receive the centering projection extending from the pad therewithin.

The invention may be described with greater clarity and particularity by reference to the accompanying drawings.

DESCRIPTION OF THE DRAWINGS

FIG. 1 is a exploded perspective view, partially broken away, illustrating one preferred embodiment of the centering apparatus of the invention.

FIG. 9 is a sectional elevational detail of a backing mount of alternative design.

DESCRIPTION OF THE EMBODIMENT

Figure 6:
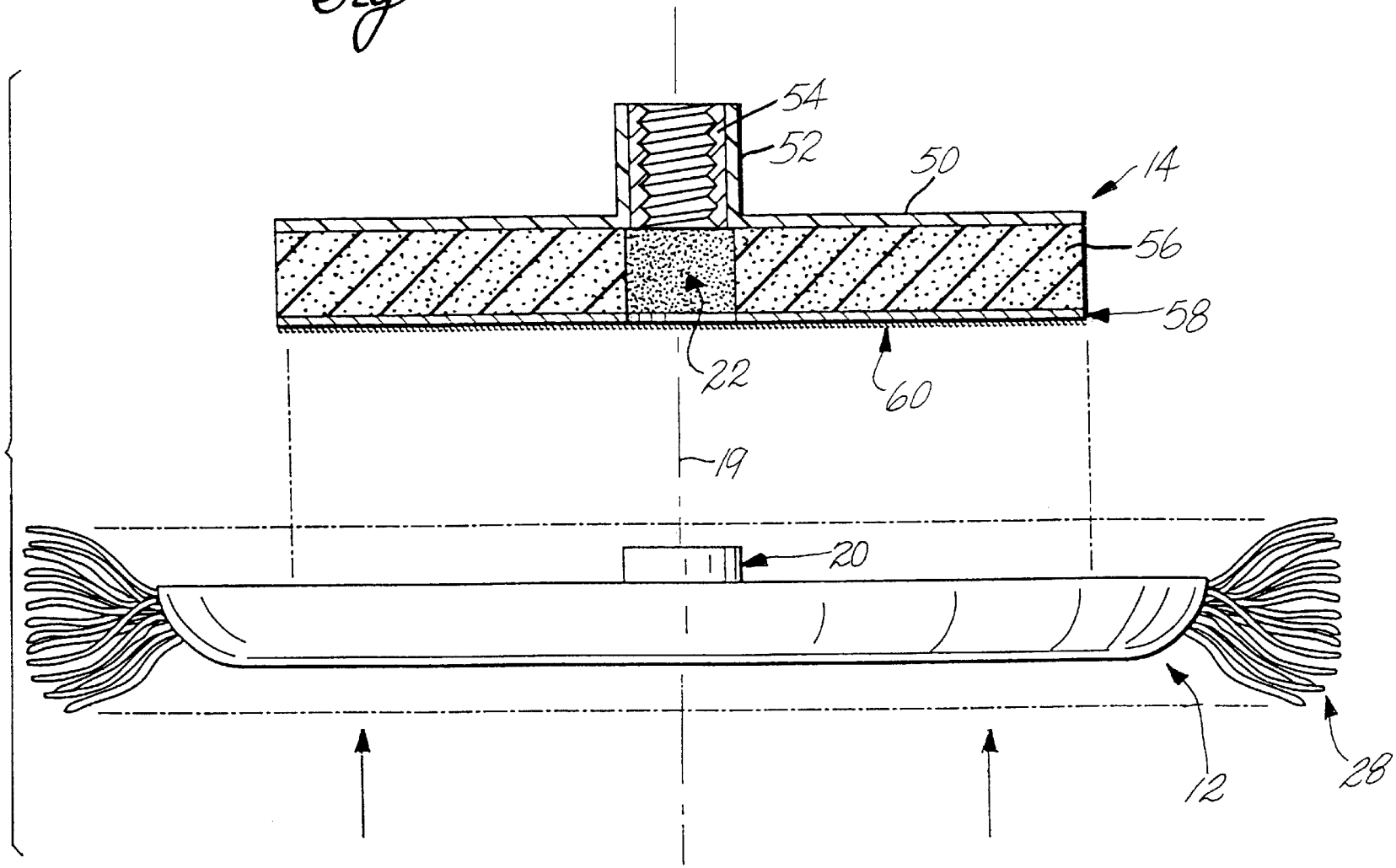
FIG. 6 is a side elevational view of the apparatus of FIG. 1, shown partially in section.

FIGS. 1 and 6 illustrate a combination according to the invention that includes a polishing pad 12 and a stiff, pad-backing mount 14 employing the centering system 10 of the invention. The rotatable surface-finishing pad 12 has a lower, surface-finishing face 16 and an upper, opposite, mounting face 18, both perpendicular to the axis 19. The surface-finishing pad 12 is provided with an axially aligned centering post 20 of uniform outer, cylindrical cross section throughout. The centering post 20 projects upwardly from the mounting face 18 of the pad. The backing mount 14 includes an axially aligned socket 22 defined therewithin and formed with a uniform, cylindrical, inner cross section. The socket 22 snugly receives the centering post 20 of the surface-finishing pad 12 therewithin when the pad 12 is moved toward the backing mount 14, as indicated in FIG. 6, and into contact therewith.

The details of construction of the finishing pad 12 are best illustrated in FIGS. 2 through 5. As shown in those drawing figures, the pad 12 has a lower face 16 formed as the bottom surface of a disk of a nonwoven, polyester material through which wool yarn is stitched. The stitched loops of yarn are cut to form fiber lengths 26 that collectively form a thick, shag, polishing pile 28. The fibers 26 are typically between about one inch and about two inches long.

Directly atop the disk 17 there are a pair of stacked, thermoplastic, circular, annular sheets 29 and 30 that reside directly atop the stitched, nonwoven layer 17. The circular plastic sheets 29 and 30 may be formed, for example, of polyethylene.

Figure 2:
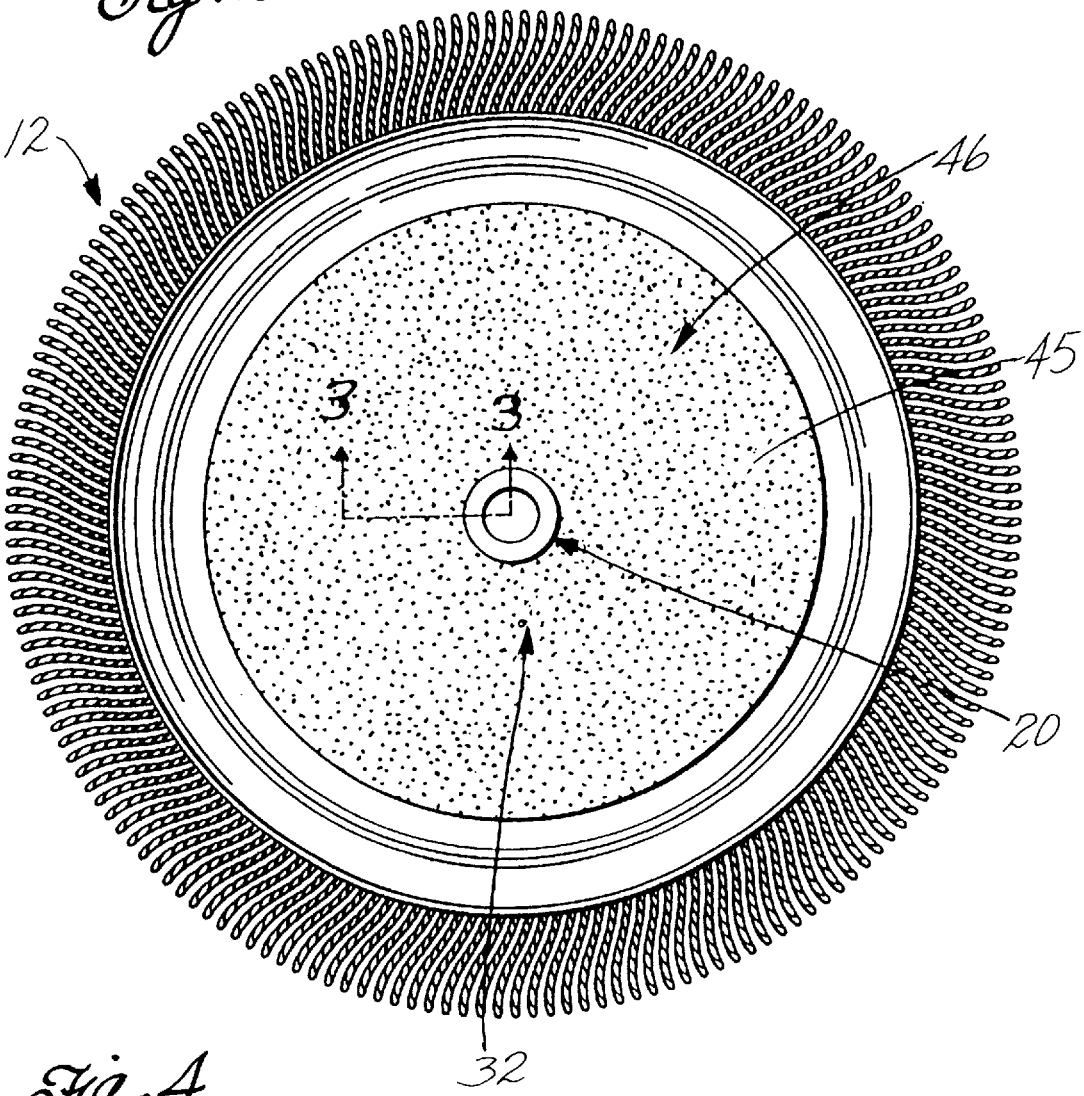
FIG. 2 is a top plan view of the pad employed in the apparatus of FIG. 1.
Figure 4:
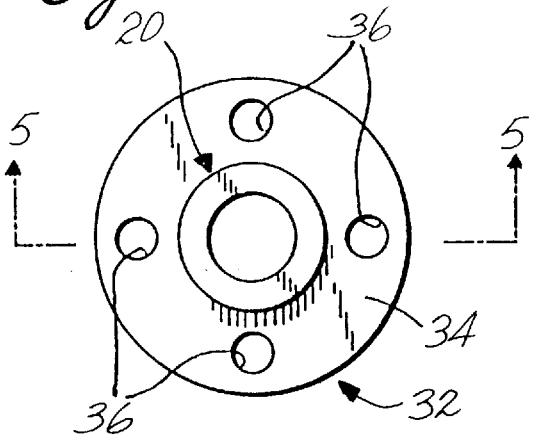
FIG. 4 is a top plan view of a flanged barrel, shown in isolation, employed in the apparatus of FIG. 1.
Figure 5:
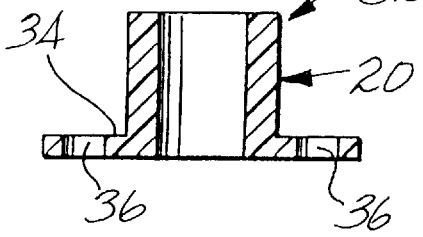
FIG. 5 is a sectional elevational detail taken along the lines 5—5 of FIG. 4.

The cylindrical, annular mounting post 20 is formed by the tubular portion of a flanged barrel 32, illustrated in isolation in FIGS. 4 and 5. The flanged barrel 32 may be formed, for example, of polyvinyl chloride plastic. The cylindrical, annular portion of the flanged barrel 32 that forms the centering post 20 may have an inner diameter of 0.5 inches and an outer diameter of 0.850 inches. The centering post 20 projects upwardly a distance of perhaps 0.687 inches above a radially outwardly projecting, annular flange 34. The flange 34 has an outer diameter of 1.75 inches and is perforated by four equally spaced apertures 36, each about 0.25 inches in diameter.

Figure 3:
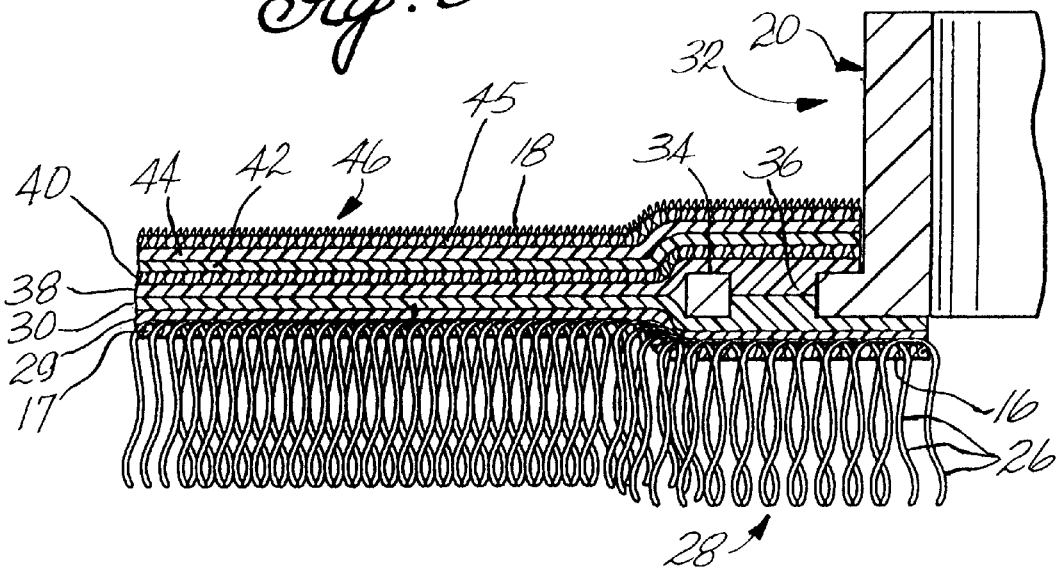
FIG. 3 is a sectional elevational detail taken along the lines 3—3 of FIG. 2.

As illustrated in FIG. 3, the flange 34 of the flanged barrel 32 rests atop the circular plastic sheet 30 so that the centering post 20 projects upwardly therefrom. A further polyethylene plastic sheet 38 is laid atop the plastic sheet 30 and also overlies the flange 34 of the flanged barrel 32. Atop the plastic sheet 38 there is another circular sheet 40, formed of canvass. Atop the canvass layer 40 there is yet another pair of circular, polyethylene plastic sheets 42 and 44. Overlying the topmost plastic sheet 44 there is a contact-sensitive fabric layer 45 bearing a multiplicity of flexible fabric, releasable fastening loops indicated generally at 46. As is evident in FIG. 3, the flange 34 of the flanged barrel 32 rests atop the lowermost layers of plastic sheets 29 and 30, which reside directly atop the nonwoven layer 17, and beneath the plastic sheet 38, the canvass sheet 40, the uppermost pairs of plastic sheets 42 and 44, and the contact-sensitive layer 45 bearing the flexible fabric fastener pile 46.

Once the several layers of backing material have been assembled as illustrated with the flange 34 sandwiched therebetween, they are heat sealed together. During the heat sealing process the plastic layers 30 and 38 fuse together at their interface, and also fuse together through the apertures 36 in the flange 34. When the plastic layers fuse together and permeate the structure of the canvass layer 40 and the nonwoven layer 17, they create a backing at the mounting surface 18 that holds its shape and is not particularly supple, although it can be resiliently bent.

The backing mount 14 is illustrated in detail in FIG. 6. The backing mount 14 is a stiff structure which includes certain rigid elements. Specifically, the backing mount 14 is configured with a rigid, plastic disk 50 formed of acronitrile butadiene styrene (ABS), which may, for example, be about five and a half inches in outer diameter. The ABS disk 50 is formed with a upwardly projecting boss 52 at its center. Within the boss 52 there is an internally threaded nipple 54 having threads thereon adapted for engagement with a rotary power tool attachment.

Beneath the ABS disk 50 there is a closed-cell polyurethane foam disk 56 at the center of which the socket 22 is defined. The closed-cell polyurethane foam layer 56 may, for example, be about eleven-sixteenths of an inch in thickness. The socket 22, for example, may have an inner diameter of seven-eighths of an inch. On its underside the backing mount includes a contact-sensitive fabric layer 58 that is engageable with the contact-sensitive layer 45 and which bears a multiplicity of tiny, flexible, fabric hooks, indicated generally at 60.

The centering device 10 of the invention is utilized as illustrated in FIGS. 1 and 6. Specifically, when the pad 12 is to be releasably attached to the backing mount 14, it is moved into coaxial alignment therewith and in longitudinally spaced separation therefrom, as illustrated in FIGS. 1 and 6. The pad 12 is then moved toward the backing mount 14 while maintaining coaxial alignment about the axis 19. The centering post 20 thereupon enters the socket 22 prior to engagement of the hooks 60 with the looped pile 46. Since the centering post 20 fits snugly within the socket 22, this ensures that the pad 12 will remain properly centered and in precise coaxial alignment with the backing mount 14 once the flexible fabric hooks 60 in the releasable hook and loop fabric fastening system engage the pile 46 thereof.

It should be noted that the polishing or buffing pad centering system 10 of the invention allows polishing pads 12 of any size to be utilized with a single backing mount 14. Typically, polishing pads 12 are commercially available in diameters of seven and a half, eight, nine, and even twelve inches.

It should also be noted that there is no hard structure in the polishing pad 12 that is exposed at the polishing face 16. To the contrary, the flange 34 of the flanged barrel 32 is shielded from contact with the surface being polished not only by the shag pile 28, but also by the nonwoven layer 17.

Figure 7:
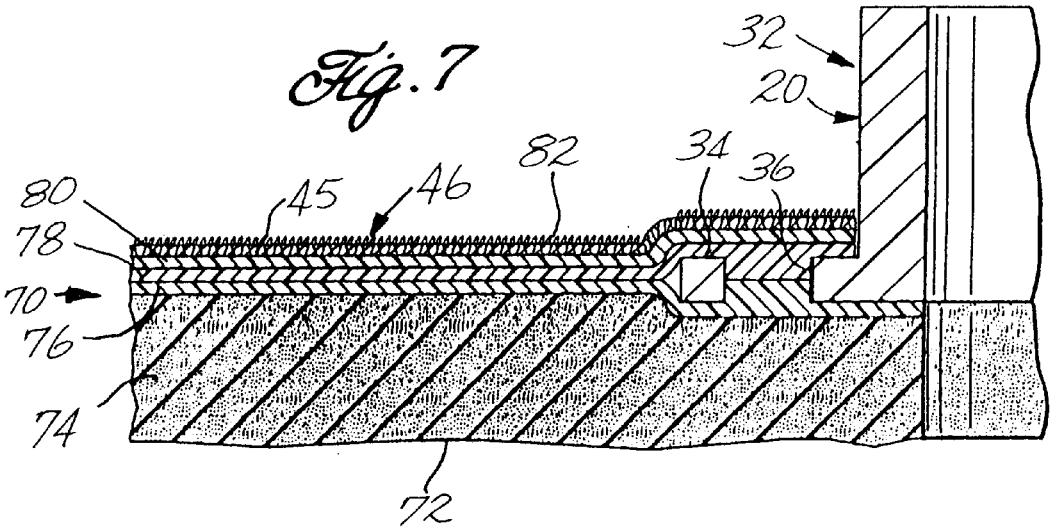
FIG. 7 is a sectional elevational detail illustrating an apparatus according to the invention employing a pad of foam construction.

Use of the invention is not restricted to polishing pads having the construction depicted in FIGS. 1–6. FIG. 7. illustrates a polishing pad 70 employing the same centering system 10. As illustrated in FIG. 7, the polishing face 72 of the pad 70 is formed by the exposed surface of an open-cell, polyurethane foam disk 74 that is about two inches in thickness. Atop the foam disk 74 there is a circular sheet 76 of polyethylene plastic approximately ten mils in thickness. The flange 34 of the flanged barrel 32 rests atop the plastic layer 76. Two additional polyethylene plastic layers 78 and 80 overlie the plastic layer 76 and also the flange 34. Atop the plastic sheet 80 there is a hook and loop contact layer 45 bearing a multiplicity of fastening loops 46.

As in the embodiment of FIGS. 1–6, all of the plastic layers 76, 78, and 80 are fused together to maintain the shape of the pad 70 as it is pressed against a surface to be polished. The plastic of the layers 76 and 78 fuses together through the apertures 36 in the flange 34 to firmly anchor the flange 34 therebetween. The centering post 20 is thereby held firmly to extend in an axial direction centered on the axis 19 and normal to both the polishing surface 72 and the opposite, mounting surface 82 of the foam pad 70.

Figure 8:
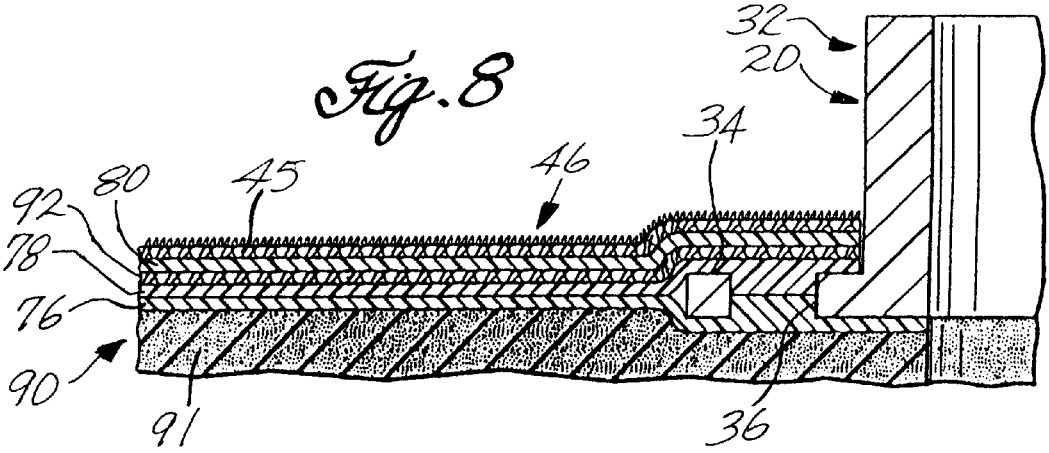
FIG. 8 is a sectional elevational detail illustrating the apparatus of the invention employing a foam pad having an alternative construction to that depicted in FIG. 7.

FIG. 8 illustrates another embodiment of the invention employing a foam pad 90 of construction that differs from that of FIG. 7. The pad 90 also employs a disk of foam 91, typically about one and a half inches in thickness. As in the embodiment of FIG. 7, the circular plastic sheet 76 overlies the foam disk 74 and the flange 34 of the flanged barrel 32 rests atop the plastic sheet 76. The next circular sheet 78 of plastic overlies the plastic sheet 76. The primary difference in the construction of the pad 90 and the pad 70 is the presence of a disk 92 of canvass between the plastic sheets 78 and 80. The centering system 10 of the invention operates in the same manner in all of the embodiments illustrated.

There is no particular structural limitation on the backing mount either. FIG. 9 illustrates a backing mount 96 that is somewhat different from the backing mount 14. The backing mount 96 is formed of a rigid, upper disk 98 of hard plastic, such as ABS. At its center, the disk 98 forms an upwardly projecting boss 100. Atop the boss 100 there is a circular plate 102 from which an externally threaded stud 104 projects upwardly. The circular plate 102 is fastened to the rigid plastic disk 98 by means of fasteners 106. A contact layer 58 on the underside of the foam disk 98 provides a multiplicity of minute, flexible hooks 60 that engage the corresponding pile 46 of any one of the pads 12, 70, or 90. As in the backing mount 14, the backing mount 96 defines a hollow, cylindrical cavity at its center, beneath the plate 102, thereby forming a socket 22 as in the backing mount 14.

Undoubtedly, numerous variations and modifications of the invention will readily become apparent to those familiar with polishing, buffing, and finishing tools and accessories. For example, the centering post 20 need not necessarily be hollow, but can be solid, if desired. Also, the centering post and socket are not necessarily cylindrical, but can have a polygonal or any other geometric cross section. Accordingly, the scope of the invention should not be construed as limited to the specific embodiments thereof depicted and described.

I claim:

1. In an apparatus for releasable attaching a rotatable surface finishing pad having a surface-finishing face and an opposing mounting face to a stiff backing mount, the improvement wherein said surface finishing pad is provided with an axially aligned centering post of uniform outer cross-sectional configuration throughout having a first end and a second end, the second end projecting from said mounting face of said pad, and an axially aligned socket defined in said stiff backing mount and formed with a uniform inner cross section to snugly receive said centering post of said surface finishing pad therewithin, wherein the first end of the centering post is embedded in the finishing pad between the finishing face and the mounting face, wherein the finishing pad comprises a plurality of plastic layers located below the mounting face, and wherein at least one of the plurality of plastic layers is positioned above the first end of the centering post and at least one of the Plurality of plastic layers is positioned below the first end of the centering post.

2. An apparatus according to claim 1 wherein said mounting face of said surface-finishing pad and said stiff backing mount include a pair of mutually engageable contact-sensitive members wherein one of said contact-sensitive members in said pair is formed with a multiplicity of minute, flexible hooks and the other of said contact-sensitive members is formed with a looped fabric pile thereon, wherein said flexible hooks are releasably engageable with said pile when said contact-sensitive members are brought into contact with each other.

3. An apparatus according to claim 1 wherein said centering post and said socket are both cylindrical.

4. An apparatus according to claim 3 wherein said surface-finishing pad is provided with a flanged barrel having a cylindrical, annular portion that forms said centering post and a radially projecting annular flange at the first end of the centering post that is permanently embedded in said surface-finishing pad between said surface-finishing face and said mounting face.

5. In an apparatus for releasable attaching a rotatable surface finishing pad having a surface-finishing face and an opposing mounting face to a stiff backing mount, the improvement wherein said surface finishing pad is provided with an axially aligned centering post of uniform outer cross-sectional configuration throughout protecting from said mounting face of said pad, and an axially aligned socket defined in said stiff backing mount and formed with a uniform inner cross section to snugly receive said centering post of said surface finishing pad therewithin, wherein said centering post and said socket are both cylindrical, wherein said surface finishing pad is provided with a flanged barrel having a cylindrical, annular Portion that forms said centering post and a radially protecting annular flange that is permanently embedded in said surface-finishing pad between said surface-finishing face and said mounting face, and wherein said surface-finishing pad is formed with at least two annular plastic layers residing in mutual contact with each other and located proximate said mounting face, said annular flange resides between said plastic layers, and said plastic layers are fused together throughout an interface of mutual contact, thereby entrapping said annular flange therebetween.

6. Apparatus according to claim 5 wherein said annular flange has a plurality of apertures defined therethrough and said layers of plastic are fused together through said apertures.

7. In a power driven apparatus for finishing a surface by rotating a finishing pad thereagainst, wherein said finishing pad has a surface-finishing face and an opposing mounting face and is releasably attached to a stiff mounting, the improvement comprising an axially aligned centering post of uniform outer cross section throughout having a first end and a second end, the second end projecting from said pad, and an axial socket defined in said stiff mounting and having a uniform inner cross section that snugly receives said centering post to thereby maintain said finishing pad and said stiff mounting in mutual coaxial alignment, wherein the first end of the centering post is embedded in the finishing pad between the finishing face and the mounting face, wherein the finishing pad comprises a plurality of plastic layers located below the mounting face, and wherein at least one of the plurality of plastic layers is positioned above the first end of the centering post and at least one of the plurality of plastic layers is positioned below the first end of the centering post.

8. Apparatus according to claim 7 further comprising interengageable layers of flexible fabric hook and loop fasteners that releasably attach said finishing pad and said stiff mounting together.

9. Apparatus according to claim 7 wherein said centering post and said socket both have a cylindrical configuration.

10. Apparatus according to claim 7 wherein said stiff mounting is provided with an internally threaded nipple coaxial with and longitudinally displaced from said socket.

11. Apparatus according to claim 7 wherein said stiff mounting is provided with an externally threaded stud coaxial with and longitudinally displaced from said socket.

12. Apparatus according to claim 7 wherein said centering post is formed as the tubular portion of a cylindrical, annular member having a radially projecting flange at the first end of the centering post, and said flange is embedded in the structure of said finishing pad.

13. In a power driven apparatus for finishing a surface by rotating a finishing pad thereagainst, wherein said finishing pad is releasably attached to a stiff mounting, the improvement comprising an axially aligned centering post of uniform outer cross section throughout protecting from said pad, and an axial socket defined in said stiff mounting and having a uniform inner cross section that snugly receives said centering post to thereby maintain said finishing and said stiff mounting in mutual coaxial alignment, wherein said centering post is formed as a tubular portion of a cylindrical, annular member having a radially protecting flange at one end, said flange being embedded in finishing pad, and wherein said finishing pad is fabricated from layers of plastic fused together with said flange of said cylindrical annular member entrapped therebetween.

14. Apparatus according to claim 13 wherein said flange has a plurality of apertures therethrough and said layers of plastic are fused together through said flange apertures.

15. In combination, a polishing pad for rotation about a driving axis that has one polishing face and an opposite mounting face, a centering projection firmly secured to said pad at a first end, having a uniform outer configuration, and extending axially from said mounting face of said pad at a second end, and a pad backing mount defining an axially aligned socket of uniform inner cross section throughout formed to snugly receive said centering projection from said pad therewithin, wherein the first end of the centering projection is embedded in the polishing pad between the finishing face and the mounting face, wherein the polishing pad comprises a plurality of plastic layers located below the mounting face, and wherein at least one of the plurality of plastic layers is positioned above the first end of the centering projection and at least one of the plurality of plastic layers is positioned below the first end of the centering projection.

16. A combination according to claim 15 wherein said centering projection has a smooth cylindrical outer surface and said socket has a smooth, cylindrical inner surface.

17. A combination according to claim 16 wherein said centering projection is hollow.

18. A combination according to claim 17 wherein said centering projection is formed as a cylindrical annular portion of a tubular anchoring member having a radially projecting flange at the first end of the centering projection, and said radially projecting flange is embedded in said polishing pad.

19. A combination according to claim 16 wherein said pad backing mount has an externally threaded attachment stud thereon for connection to a rotary power source.

20. A combination according to claim 16 wherein said pad backing mount has an internally threaded attachment nipple thereon for connection to a rotary power source.

21. A finishing pad assembly comprising:

a finishing pad having a finishing face, a mounting face opposite the finishing face, and a plurality of plastic layers located below the mounting face; and a centering system including an axially aligned centering post having a first end and a second end, the second end projecting from the mounting face of the finishing pad, wherein the first end of the centering post is embedded in the finishing pad between the finishing face and the mounting face, and wherein at least one of the plurality of plastic layers is positioned above the first end of the centering post and wherein at least one of the plurality of plastic layers is positioned below the first end of the centering post.

22. The finishing pad assembly according to claim 21 wherein the first end of the centering post comprises an annular flange.

23. The finishing pad assembly according to claim 22 wherein the plurality of plastic layers are fused together around the annular flange.

24. The finishing pad assembly according to claim 23 wherein the annular flange comprises a plurality of apertures, and wherein the plurality of plastic layers are fused together through the plurality of apertures.

25. The finishing pad assembly according to claim 21 further comprising a backing mount, and wherein the mounting surface of the finishing pad is removably secured to the backing mount.

26. The finishing pad assembly according to claim 21 further comprising a layer of fastening material on the mounting surface of the finishing pad to removably secure the finishing pad to a backing mount.

27. The finishing pad assembly according to claim 26 wherein the centering post is cylindrical.

28. The finishing pad assembly according to claim 27 wherein the centering system further comprises an axially aligned socket defined in the backing mount to receive the centering post.

* * * * *